US008285458B2

(12) United States Patent
Mintah et al.

(10) Patent No.: US 8,285,458 B2
(45) Date of Patent: Oct. 9, 2012

(54) MACHINE WITH AUTOMATIC OPERATING MODE DETERMINATION

(75) Inventors: Brian Mintah, Washington, IL (US); Jeffrey Lee Kuehn, Metamora, IL (US); Qiaoyan Huang, Houston, TX (US)

(73) Assignee: Caterpillar Inc., Peoria, IL (US)

( * ) Notice: Subject to any disclaimer, the term of this patent is extended or adjusted under 35 U.S.C. 154(b) by 1209 days.

(21) Appl. No.: 12/081,646

(22) Filed: Apr. 18, 2008

(65) Prior Publication Data

US 2009/0265047 A1 Oct. 22, 2009

(51) Int. Cl.
*G06F 19/00* (2011.01)

(52) U.S. Cl. ..... 701/50

(58) Field of Classification Search ..... 701/50
See application file for complete search history.

(56) References Cited

U.S. PATENT DOCUMENTS

| | | | |
|---|---|---|---|
| 3,703,931 | A | 11/1972 | Page et al. |
| 4,757,454 | A | 7/1988 | Hisatake et al. |
| 4,853,859 | A | 8/1989 | Morita et al. |
| 5,065,326 | A | 11/1991 | Sahm |
| 5,105,895 | A | 4/1992 | Kyrtsos |
| 5,493,798 | A | 2/1996 | Rocke et al. |
| 5,714,719 | A | 2/1998 | Otsuka et al. |
| 5,794,369 | A | 8/1998 | Lee et al. |
| 5,826,666 | A | 10/1998 | Tozawa et al. |
| 5,890,303 | A | 4/1999 | Ishikawa et al. |
| 5,950,428 | A | 9/1999 | Nam et al. |
| 5,953,838 | A | 9/1999 | Steenwyk |
| 5,974,352 | A | 10/1999 | Shull |
| 6,055,851 | A | 5/2000 | Tanaka et al. |
| 6,070,539 | A | 6/2000 | Flamme et al. |
| 6,108,948 | A | 8/2000 | Tozawa et al. |
| 6,204,772 | B1 | 3/2001 | DeMay et al. |
| 6,205,687 | B1 | 3/2001 | Rocke |
| 6,339,737 | B1 | 1/2002 | Yoshimura et al. |
| 6,618,658 | B1 | 9/2003 | Kagoshima et al. |
| 6,751,541 | B2 | 6/2004 | Komatsu et al. |
| 6,879,969 | B2 | 4/2005 | Engström et al. |
| 6,907,336 | B2 * | 6/2005 | Gray et al. ..... 701/50 |
| 6,915,599 | B2 | 7/2005 | Lohnes et al. |
| 7,069,131 | B2 | 6/2006 | Kim |
| 7,124,056 | B2 | 10/2006 | Shibamori et al. |
| 7,222,051 | B2 | 5/2007 | Shibata et al. |
| 7,276,669 | B2 | 10/2007 | Dahl et al. |
| 2003/0037465 | A1 | 2/2003 | Toji et al. |
| 2003/0089002 | A1 | 5/2003 | Bares et al. |
| 2004/0060205 | A1 | 4/2004 | Yoshino |
| 2004/0117094 | A1 | 6/2004 | Colburn |
| 2004/0117095 | A1 | 6/2004 | Colburn et al. |
| 2005/0044753 | A1 | 3/2005 | Lohnes et al. |
| 2005/0283295 | A1 | 12/2005 | Normann |
| 2006/0123672 | A1 | 6/2006 | Ichimura et al. |
| 2006/0129280 | A1 | 6/2006 | Thomas et al. |
| 2007/0050115 | A1 | 3/2007 | Discenzo et al. |
| 2007/0239328 | A1 | 10/2007 | Saposnik |
| 2009/0265047 | A1 * | 10/2009 | Mintah et al. ..... 701/1 |

* cited by examiner

*Primary Examiner* — Thomas B Will
*Assistant Examiner* — Joel F. Mitchell
(74) *Attorney, Agent, or Firm* — Finnegan, Henderson, Farabow, Garrett & Dunner LLP

(57) ABSTRACT

A method is provided for determining a current operating mode of a machine. The method includes receiving data relating to a plurality of machine parameters and performing initial comparisons between the received data and previously stored reference data for each machine parameter. The method also includes determining an operating mode indicated by each initial comparison. The method further includes selecting a current operating mode from the operating modes indicated by the initial comparisons.

17 Claims, 9 Drawing Sheets

MACHINE WITH AUTOMATIC OPERATING MODE DETERMINATION

TECHNICAL FIELD

The present disclosure is directed to a machine and, more particularly, to a machine capable of automatically determining a current operating mode.

BACKGROUND

Machines such as, for example, excavators, wheel loaders, dozers, backhoes, dump trucks, and other heavy equipment are used to perform many tasks such as, for example, loading a bucket, digging a trench, compacting soil, etc. Each of these tasks impose unique demands on various systems of the machine. For example, an optimal distribution of hydraulic fluid among various components of the machine during a bucket loading operation may be different from an optimal distribution of hydraulic fluid during a trench digging operation. In addition, an optimal sensitivity for operator input devices during a bucket loading operation may be different from an optimal sensitivity for operator input devices during a trench digging operation. If a machine were able to automatically determine its current operating mode, it might be able to adjust the various systems for optimal performance.

One example of a machine that identifies a current operating mode can be found in U.S. Patent Publication No. US2005/0283295 (the publication) by Normann on Dec. 22, 2005. The publication discloses a skid steer loader having an operating mode identification system. The system receives data related to a current operating mode and creates a current application signature. The identification system compares this current application signature to stored application signatures relating to various operating modes of the skid steer loader. The stored signature that most closely matches the current application signature is determined to be the current operating mode.

Although the system disclosed in the publication may identify a current operating mode of the machine, the accuracy of the system may be limited. In particular, only one current application signature is calculated from the current data. However, under some conditions, data from different machine parameters may identify different operating modes as the current operating mode. Calculating only one application signature from the current data may include conflicting data that may taint the comparison and may cause the system to identify the wrong operating mode.

The disclosed system is directed to overcoming one or more of the problems set forth above.

SUMMARY

In one aspect, the present disclosure is directed toward a method for determining a current operating mode of a machine. The method includes receiving data relating to a plurality of machine parameters and performing initial comparisons between the received data and previously stored reference data for each machine parameter. The method also includes determining an operating mode indicated by each initial comparison. The method further includes selecting a current operating mode from the operating modes indicated by the initial comparisons.

Consistent with a further aspect of the disclosure, a method is provided for determining a current operating mode of a machine. The method includes creating and storing reference data for each of a plurality of machine parameters. The reference data relating to each machine parameter has unique reference signatures for each of a plurality of operating modes. The method also includes receiving current data relating to the plurality of machine parameters. The current data relating to each machine parameter has a unique parameter signature. The method further includes performing initial comparisons between the parameter signature and the reference signatures for each machine parameter. Furthermore, the method includes determining an operating mode indicated by each initial comparison and selecting a current operating mode from the operating modes indicated by the initial comparisons.

Consistent with yet another aspect, the disclosure is directed to an operating mode determination system for a machine. The operating mode determination system includes one or more operator input devices and one or more sensors. The operating mode determination system also includes a processing device. The processing device is configured to receive data from the one or more operator input devices and the one or more sensors, the data being related to a plurality of machine parameters. The processing device is also configured to perform initial comparisons between the received data and the reference data for each machine parameter. The processing device is further configured to determine an operating mode indicated by each initial comparison and select a current operating mode from the operating modes indicated by the initial comparisons.

DETAILED DESCRIPTION

Figure 1:
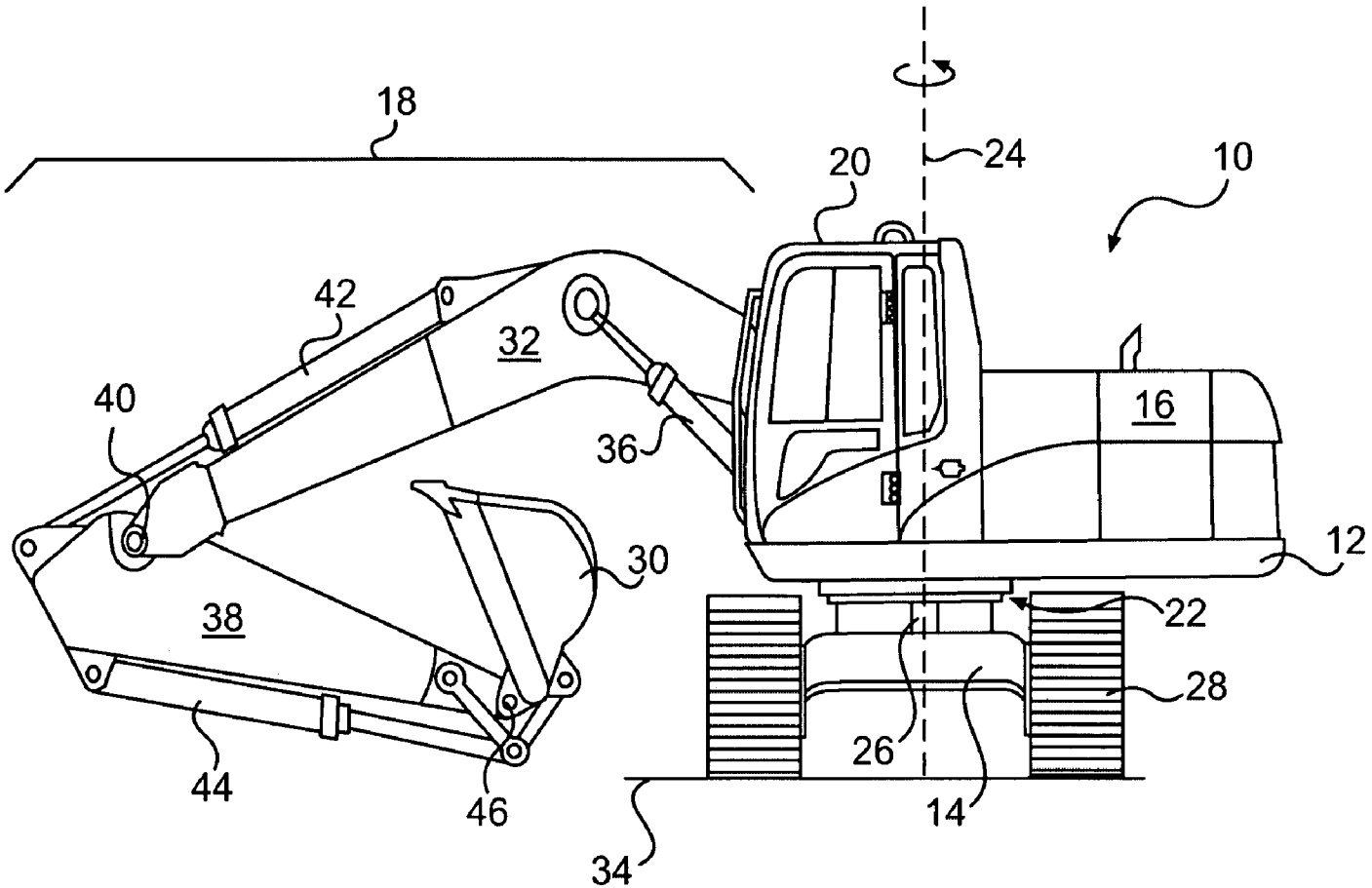
FIG. 1 is a diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or any other industry known in the art. For example, machine 10 may be an earth moving machine such as an excavator, a dozer, a loader, a backhoe, a motor grader, a haul truck, or any other earth moving machine. Machine 10 may include a platform 12, an undercarriage 14 to which platform 12 is rotatably coupled, a power source 16, an implement system 18 coupled to platform 12, and an operator station 20 for operator control of machine 10.

Platform 12 may be a structural member supporting operator station 20 and may be coupled to undercarriage 14 via a vertical pivot 22. Vertical pivot 22 may allow platform 12 to rotate relative to undercarriage 14 about an axis 24. In other words, vertical pivot 22 may allow implement system 18 to swing or rotate in a plane substantially parallel to a work surface under machine 10 (axis 24 may be substantially normal to the work surface). In an alternative configuration (not shown), platform 12 and undercarriage 14 may be fixedly coupled and a vertical pivot or ball-type joint may couple implement system 18 to platform 12. The vertical pivot or ball-type joint of the alternative configuration may also allow for swinging or rotation of implement system 18 (axis 24 now being located at the vertical pivot or ball-type joint).

Platform 12 may be pivoted about vertical axis 24 by a hydraulic swing motor 26. Swing motor 26 may be driven by a fluid pressure differential. Specifically, swing motor 26 may include first and second chambers (not shown) located to either side of an impeller (not shown). When the first chamber is filled with pressurized fluid and the second chamber is drained of fluid, the impeller may be urged to rotate in a first direction. Conversely, when the first chamber is drained of fluid and the second chamber is filled with pressurized fluid, the impeller may be urged to rotate in an opposite direction. The flow rate of fluid into and out of the first and second chambers may determine an output rotational velocity of swing motor 26, while a pressure differential across the impeller may determine an output torque.

Undercarriage 14 may be a structural support for one or more traction devices 28. Traction devices 28 may include tracks located on each side of machine 10 configured to allow translational motion of machine 10 across a work surface. Alternatively, traction devices 28 may include wheels, belts, or other traction devices known in the art. Any of traction devices 28 may be drivable and/or steerable. It is contemplated that swinging or rotation of implement system 18 may also be achieved by driving one traction device 28 in a first direction while driving a second traction device 28 in a second direction generally opposite to the first direction.

Power source 16 may provide power for the operation of machine 10. Power source 16 may embody a combustion engine, such as a diesel engine, a gasoline engine, a gaseous fuel powered engine (e.g., a natural gas engine), or any other type of combustion engine known in the art. Power source 16 may alternatively embody a non-combustion source of power, such as a fuel cell or other power storage device coupled to a motor. Power source 16 may provide a rotational output to drive traction device 28, thereby propelling machine 10. Power source 16 may also provide power to rotate platform 12 relative to undercarriage 14 and/or power implement system 18.

Implement system 18 may include a linkage structure acted on by fluid actuators to move a tool 30. Specifically, implement system 18 may include a boom member 32 pivotally connected to platform 12 of machine 10. In addition, implement system 18 may be vertically pivotal about a horizontal axis (not shown) relative to a surface 34 by a pair of adjacent, double-acting, hydraulic cylinders 36 (only one shown in FIG. 1). Implement system 18 may also include a stick member 38 vertically pivotal about a horizontal axis 40 relative to surface 34 by a single, double-acting, hydraulic cylinder 42. Implement system 18 may further include a single, double-acting, hydraulic cylinder 44 operatively connected to tool 30 to pivot tool 30 vertically about a horizontal pivot axis 46. Stick member 38 may pivotally connect boom member 32 to tool 30 by way of axes 40 and 46.

Each of hydraulic cylinders 36, 42, 44 may include a tube and a piston assembly (not shown) arranged to form two separated pressure chambers. The pressure chambers may be selectively supplied with pressurized fluid and drained of the pressurized fluid to cause the piston assembly to displace within the tube, thereby changing an effective length of hydraulic cylinders 36, 42, 44. The flow rate of fluid into and out of the pressure chambers may relate to a velocity of hydraulic cylinders 36, 42, 44, while a pressure differential between the two pressure chambers may relate to a force imparted by hydraulic cylinders 36, 42, 44 on the associated linkage members. The expansion and retraction of hydraulic cylinders 36, 42, 44 may function to assist in moving tool 30.

Numerous different tools 30 may be attachable to a single machine 10 and controllable via operator station 20. Tool 30 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot relative to machine 10, tool 30 may alternatively or additionally rotate, slide, swing, lift, or move in any other manner known in the art.

Figure 2:
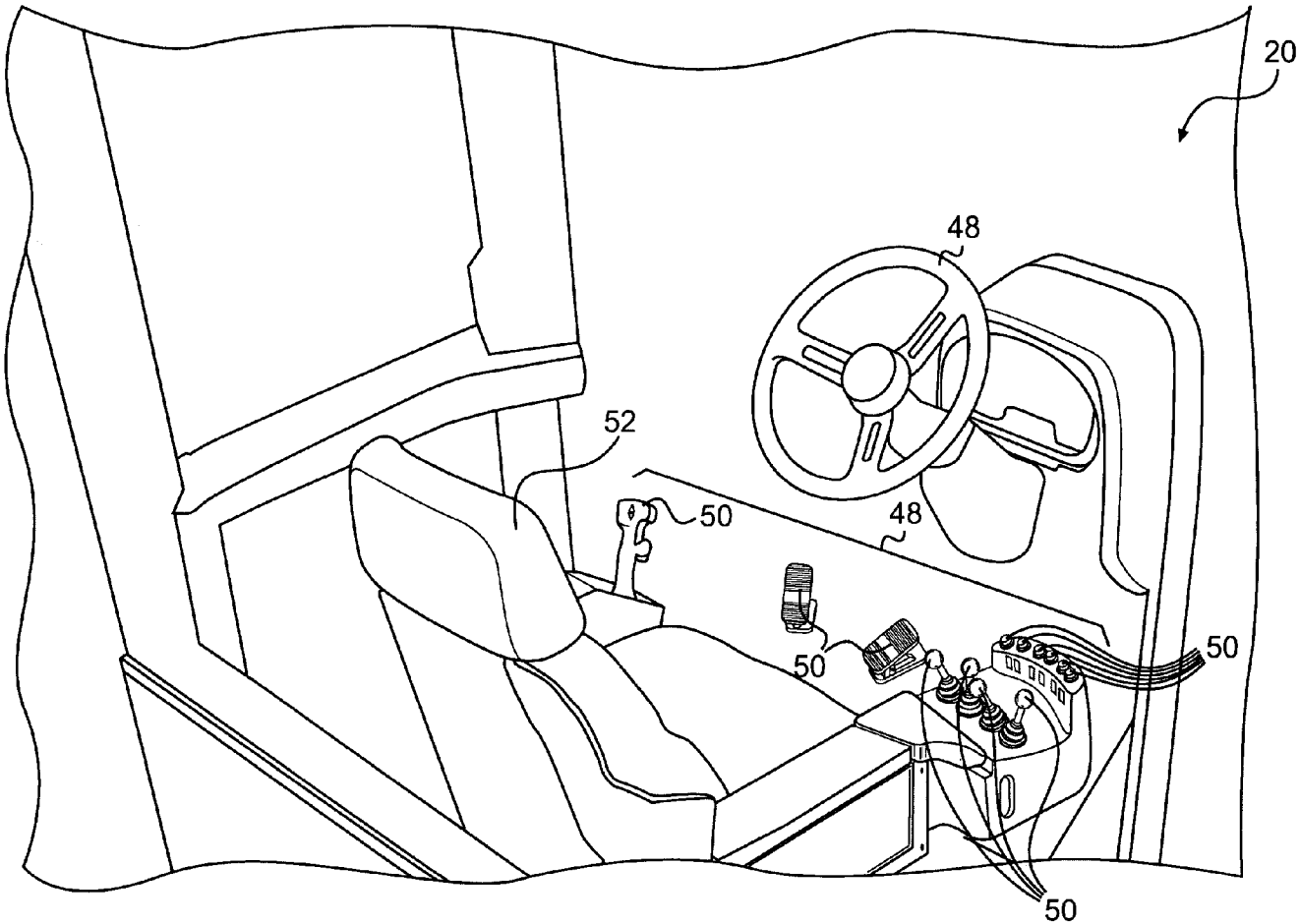
FIG. 2 is a pictorial illustration of an exemplary disclosed operator station for use with the machine of FIG. 1.

As illustrated in FIG. 2, operator station 20 may include an operator interface 48 that receives input from a machine operator indicative of a desired machine maneuver. Specifically, operator station 20 may include one or more operator input devices 50 located proximate an operator seat 52 such as, for example, a multi-axis joystick, wheels, knobs, push-pull devices, switches, pedals, and other operator interface devices known in the art. It is contemplated that a single operator input device 50 may actuate hydraulic cylinders 36, 42, 44, and swing motor 26 to position and/or orient tool 30 and produce an interface device position signal indicative of a desired movement of tool 30. Alternatively, hydraulic cylinders 36, 42, 44, and swing motor 26 may each be associated with a unique operator input device 50.

Figure 3:
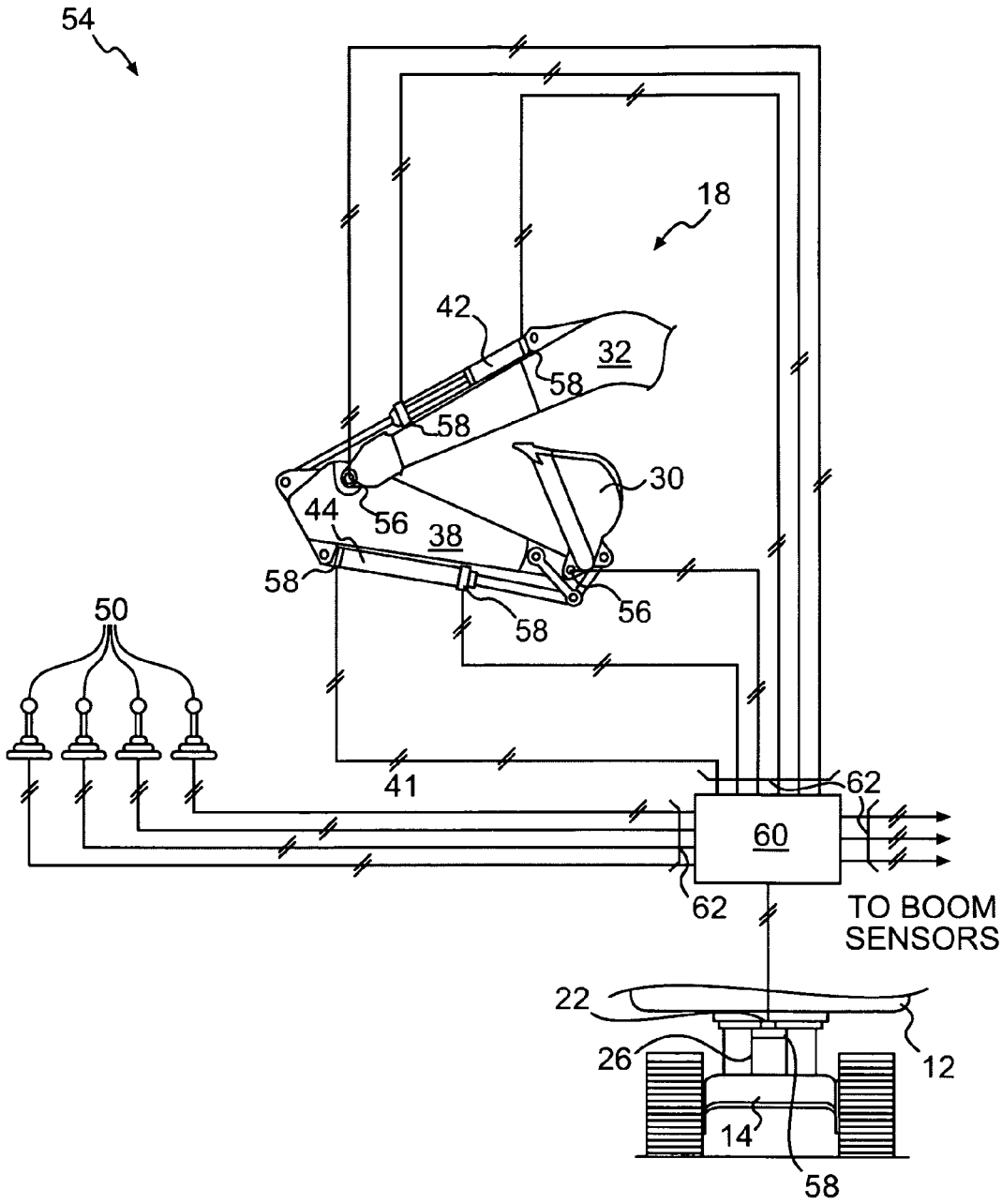
FIG. 3 is a schematic and diagrammatic illustration of an exemplary disclosed operation determination system for use with the machine of FIG. 1.

As illustrated in FIG. 3, machine 10 may include an operating mode determination system 54 for determining a current operation, which machine 10 may be performing. The current operation may be, for example, loading a truck, trenching, finishing a slope of a surface, tamping, boom up stick relief, stick shake, stick directional change or any other operation that may be performed by machine 10. Operating mode determination system 54 may include one or more state sensors 56, one or more pressure sensors 58, and a processing device 60. It is contemplated that operating mode determination system 54 may include additional sensors located throughout machine 10, if desired.

State sensors 56 may be angle sensing devices located near a pivot joint of boom member 32 (not shown), horizontal axis 40, and/or pivot axis 46. State sensors 56 may include rotary encoders, potentiometers, or other angle or position sensing devices (e.g., state sensor 56 may be located on a linear actuator and may be configured to determine a joint angle using an actuator position). Output signals of state sensors 56 may be used to determine a state of implement system 18, such as, for example, a position, a velocity, an acceleration, an angle, an angular velocity, or an angular acceleration of boom member 32, stick member 38, and tool 30. One or more state sensors 56 may additionally be located near vertical pivot 22 and may measure an angle, an angular velocity, or an angular acceleration of platform 12 relative to undercarriage 14.

Pressure sensors 58 may transmit a signal usable to determine a current hydraulic pressure differential between the first and second chambers of hydraulic cylinders 36, 42, 44, and swing motor 26, and/or boom member 32, stick member 38, and tool 30. In addition, pressure sensors 58 may be located to measure the pressure of the pressurized fluid within or supplied to the first and/or second chambers of hydraulic cylinders 36, 42, 44, and swing motor 26.

Processing device 60 may monitor the performance of machine 10 and its components. Processing device 60 may communicate via one or more communication lines 62 (or wirelessly) with state sensors 56, pressure sensors 58, and operator input devices 50. It is contemplated that processing device 60 may also communicate (not shown) with power source 16 and/or other components of machine 10. Processing device 60 may embody a single microprocessor or multiple microprocessors. Numerous commercially available microprocessors may be configured to perform the functions of processing device 60, and it should be appreciated that processing device 60 may readily embody a general machine microprocessor capable of monitoring numerous machine functions. Processing device 60 may include a memory, a secondary storage device, a processor, and any other components for running an application. Various other circuits may be associated with processing device 60, such as, for example, power supply circuitry, signal conditioning circuitry, data acquisition circuitry, signal output circuitry, signal amplification circuitry, and other types of circuitry known in the art.

Processing device 60 may receive data from sensors 56, 58 and operator input devices 50 relating to current machine parameters. For example, processing device 60 may receive data relating to the various hydraulic pressure differences encountered between the hydraulic chambers of hydraulic cylinder 36. As the data is received by processing device 60, a signature for each parameter may become apparent. These signatures may be compared to stored reference signatures relating to different operating modes. For each parameter, the operating mode associated with the reference signature having the closest correlation with the parameter signature may be designated by that parameter. The operating mode designated by the most parameters may be the current operating mode of machine 10. If the current operating mode cannot be ascertained from signature comparisons, a supplemental analysis may be performed using supplemental data.

INDUSTRIAL APPLICABILITY

The disclosed system may accurately determine the current operating mode of a machine by comparing current machine parameter data to reference data related to various operating modes. In particular, comparisons relating to each parameter may indicate a particular operating mode. The operating mode indicated by the most parameters may be determined to be the current operating mode of the machine. In addition, if the comparisons are unable to determine the current operating mode, a supplemental analysis of supplemental data may be used to determine the current operating mode. The creation of the reference data and the determination of the current operating mode will now be explained.

Figure 4:
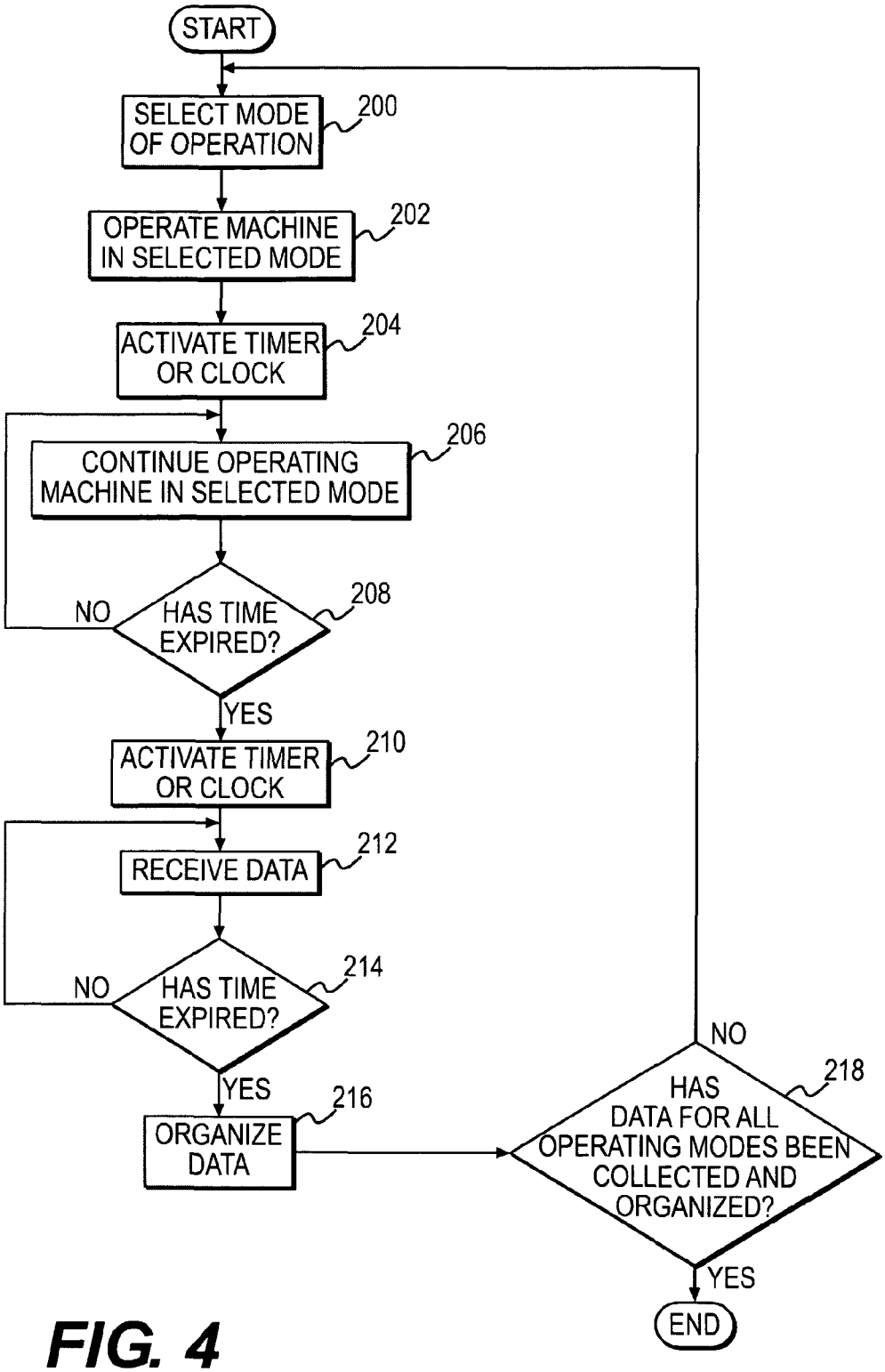
FIG. 4 is a flow chart illustrating an exemplary method for creating reference data relating to different operating modes of the machine of FIG. 1.

FIG. 4 illustrates a flow diagram depicting an exemplary method for creating reference data for different operating modes of machine 10. The method may begin when an operating mode is selected (step 200). The selected operating mode may include but is not limited to a truck loading mode, a trenching mode, a slope finishing mode, a tamping mode, a boom up stick relief mode, a stick shake mode, or a stick directional change mode. It is contemplated that the mode may be selected by an operator, processing device 60, or a system (not shown) located remotely from machine 10. Once the mode of operation is selected, machine 10 may operate in the selected mode (step 202).

It may be desired to operate machine 10 in the selected operating mode for a predetermined period of time before collecting data. This is because the transition from one mode to another may taint the data, thereby rendering the data useless for identifying any operating modes. The data collection delay may be accomplished by activating a timer or a clock (step 204). It is contemplated that the timer or clock may be situated within processing device 60, if desired. In addition, the timer or clock may be set to any amount of time that may minimize the error rate of the data due to the transition from one operating mode to another. For example, the timer or clock may be set to ten seconds. After setting the timer or clock to the desired amount of time, machine 10 may continue operating in the selected mode (step 206). While operating in the selected mode, processing device 60 may determine whether the predetermined amount of time has expired by referencing the timer or clock (step 208). If the predetermined amount of time has not expired (step 208: No), step 206 may be repeated (i.e., machine 10 may continue operating in the selected mode).

If the predetermined amount of time has expired (step 208: Yes), another timer or clock may be activated (step 210). The timer or clock may be set for any amount time that may permit processing device 60 to receive enough data to create an adequate reference for a particular operating mode of machine 10. For example, an adequate reference for the truck loading mode may include at least 75 seconds of data. In addition, an adequate reference for the trenching mode may include at least 400 seconds of data. It is contemplated that the timer or clock utilized in step 210 may be situated within processing device 60, if desired. It is further contemplated that instead of utilizing a separate timer or clock when performing step 210, the timer or clock utilized in step 204 may also be used to perform step 210.

After the timer or clock has been activated, processing device 60 may collect data indicative of various parameters that may be used to determine the current operating mode of machine 10 (step 212). Such parameters may include, for example, the displacement of operator input devices 50, the pressure difference between the hydraulic chambers of swing motor 26, the pressure difference between the hydraulic chambers of hydraulic cylinder 36, the pressure difference between the hydraulic chambers of hydraulic cylinder 42, the pressure difference between the hydraulic chambers of hydraulic cylinder 44, and/or any other parameter that may be useful for determining a current operating mode of machine 10. As data relating to a particular parameter is collected over the predetermined period of time, a unique signature may develop. This signature may be used as a reference against which current data may be compared when determining the current operating mode of machine 10. In addition, data indicative of such parameters may be received from various sources located throughout machine 10 such as, for example, operator input devices 50, state sensors 56, and pressure sensors 58.

While receiving data indicative of the various parameters, processing device 60 may determine whether the predetermined amount of time has expired by referencing the timer or clock (step 214). If the predetermined amount of time has not expired (step 214: No), step 212 may be repeated (i.e., processing device 60 may collect data indicative of various parameters that may be used to determine the current operating mode of machine 10). However, if the predetermined amount of time has expired (step 214: Yes), processing device 60 may organize the data into a format that may be useful for determining a current operating mode of machine 10 (step 216). For example, the data may be organized into charts, graphs, histograms and/or other graphical representations. After organizing the data, processing device 60 may determine whether data for all desired operating modes has been collected and organized (step 218). Processing device 60 may make the determination by referencing operator inputs or any other method capable of making the determination. If data for any desired operating mode has not been collected and organized (step 218: No), step 200 may be repeated (i.e., a mode of operation for machine 10 may be selected). However, if data for all desired operating modes has been collected and organized, the method may be terminated.

Figure 5:
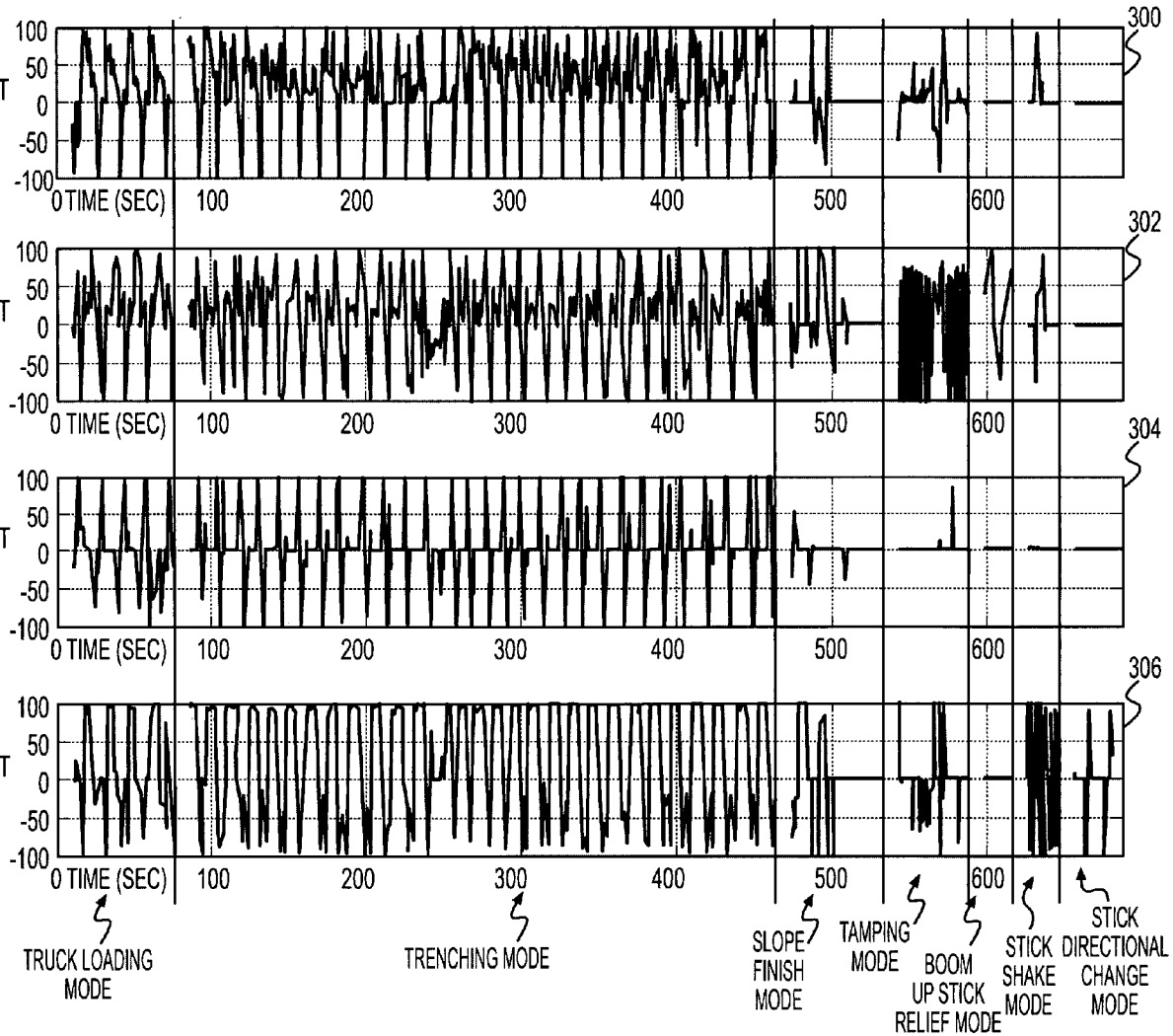
FIG. 5 illustrates exemplary graphical representations of data collected in the method of FIG. 4.
Figure 6:
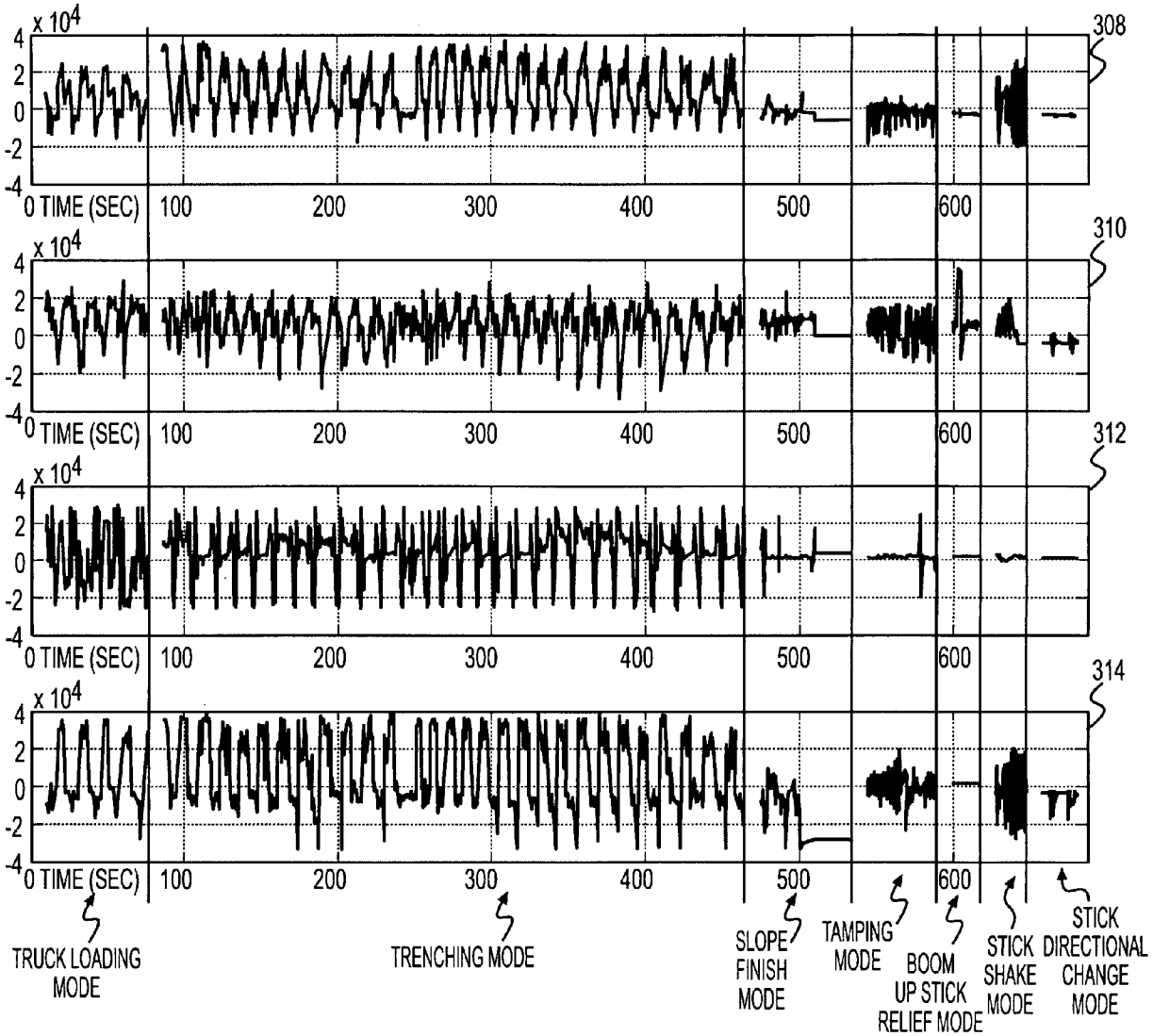
FIG. 6 illustrates additional exemplary graphical representations of data collected in the method of FIG. 4.

FIGS. 5 and 6 illustrate exemplary formats into which the collected data may be organized. In particular, FIG. 5 illustrates exemplary reference graphical representations of the manipulation of operator input devices 50 during different operating modes of machine 10. Furthermore, FIG. 6 illustrates exemplary reference graphical representations for the pressure difference between the hydraulic chambers of swing motor 26, the pressure difference between the hydraulic chambers of hydraulic cylinder 36, the pressure difference between the hydraulic chambers of hydraulic cylinder 42, and the pressure difference between the hydraulic chambers of hydraulic cylinder 44.

As illustrated in FIG. 5, processing device 60 may include a graphical representation 300 representing the displacements of the operator input device 50 used to manipulate boom member 32, a graphical representation 302 representing the displacements of the operator input device 50 used to manipulate tool 30, a graphical representation 304 representing the displacements of the operator input device 50 used to manipulate stick member 38, and a graphical representation 306 representing the displacements of the operator input device 50 used to manipulate swing motor 26.

Graphical representations 300, 302, 304, and 306 may each include an x-axis representing a duration of time that may elapse during the data retrieval process and a y-axis representing a displacement of the operator input device 50. For example, 100 may represent a displacement of 100% in the forward direction, −100 may represent a displacement of 100% in the reverse direction, and 0 may represent a neutral position. In addition, graphical representations 300, 302, 304, and 306 may be divided into sections that represent a particular mode in which machine 10 may be operating during a data collection event. For example, graphical representations 300, 302, 304, and 306 may be divided into sections relating to a truck loading mode, a trenching mode, a slope finishing mode, a tamping mode, a boom up stick relief mode, a stick shake mode, and a stick directional change mode. As can be seen, the data included in each mode may have a unique signature against which current data may be compared when determining the current operating mode of machine 10. Furthermore, graphical representations 300, 302, 304, and 306 may include gaps in the data that may be centered around the division lines between operating modes. This may represent the data collection delays disclosed above that may occur during transitions between operating modes.

As illustrated in FIG. 6, processing device 60 may include a graphical representation 308 representing a pressure difference between the hydraulic chambers of hydraulic cylinder 36, a graphical representation 310 representing a pressure difference between the hydraulic chambers of hydraulic cylinder 44, graphical representation 312 representing a pressure difference between the hydraulic chambers of hydraulic cylinder 42, and graphical representation 314 representing a pressure difference between the hydraulic chambers of swing motor 26.

Graphical representations 308, 310, 312, and 314 may each include an x-axis representing a duration of time that may elapse during the data retrieval process and a y-axis representing the sensed pressure difference. In addition, graphical representations 308, 310, 312, and 314 may be divided into sections that represent a particular mode in which machine 10 may be operating during a data collection event. For example, graphical representations 308, 310, 312, and 314 may be divided into sections relating to a truck loading mode, a trenching mode, a slope finishing mode, a tamping mode, a boom up stick relief mode, a stick shake mode, and a stick directional change mode. As can be seen, the data included in each mode may have a unique signature against which current data may be compared when determining the current operating mode of machine 10. Furthermore, graphical representations 308, 310, 312, and 314 may include gaps in the data that may be centered around the division lines between operating modes. This may represent the data collection delays disclosed above that may occur during transitions between operating modes.

Figure 7:
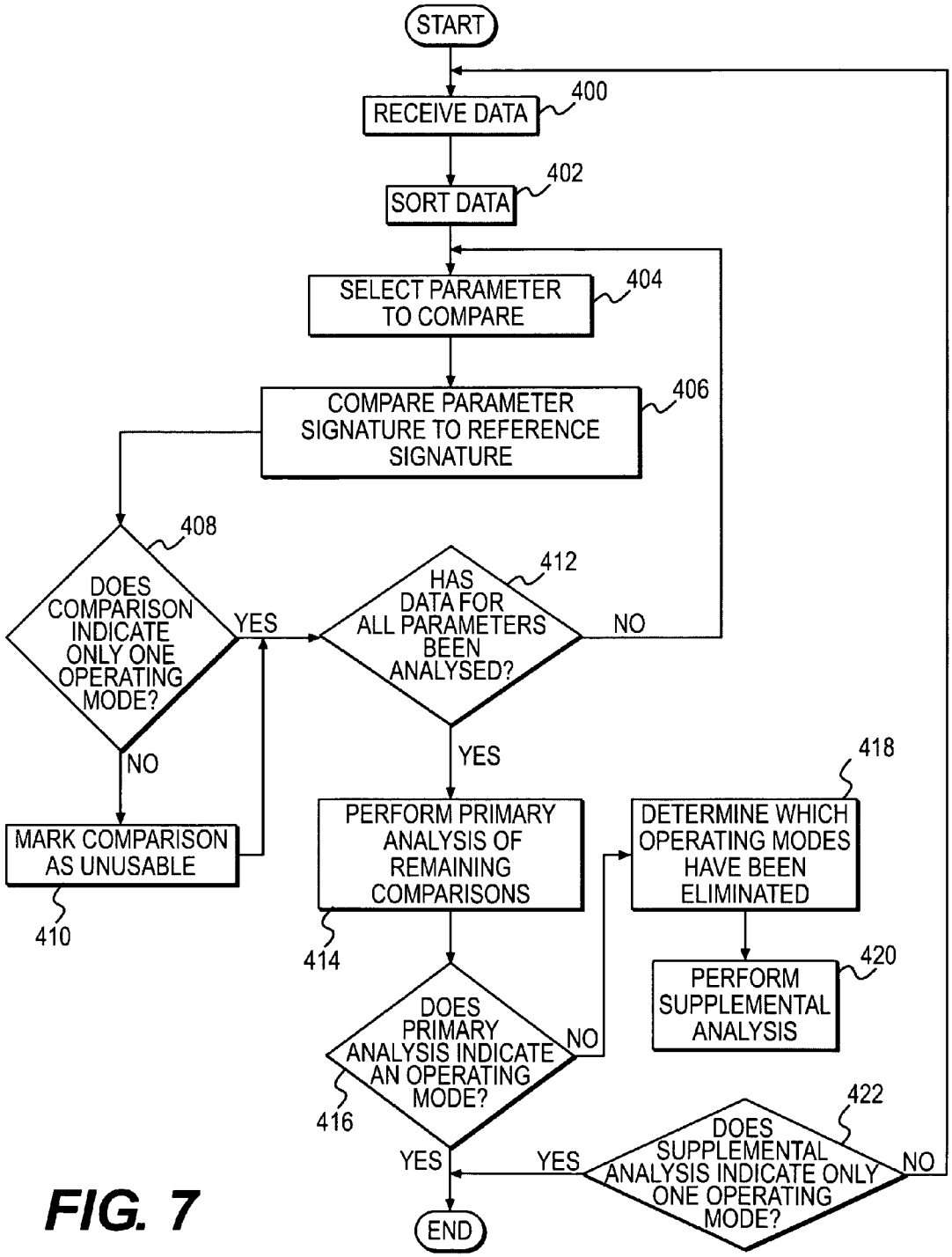
FIG. 7 is a flow chart illustrating an exemplary method for determining a current operating mode of the machine of FIG. 1

FIG. 7 illustrates a flow diagram depicting an exemplary method for determining a current operating mode of machine 10. The method may begin when data indicative of selected parameters of machine 10 is received by processing device 60 (step 400). Such parameters may include, for example, a pressure difference between the hydraulic chambers of hydraulic cylinder 36, a pressure difference between the hydraulic chambers of hydraulic cylinder 42, a pressure difference between the hydraulic chambers of hydraulic cylinder 44, a pressure difference between the hydraulic chambers of swing motor 26, displacements of the operator input devices 50 used to manipulate boom member 32, tool 30, stick member 38, and swing motor 26, and/or any other parameter that may be used to identify the current operating mode. It is contemplated that data relating to the parameters may be received from various sources such as, for example, signals transmitted by pressure sensors 58 and operator input devices 50.

After being received, the data may be sorted based on the parameter described by the data (step 402). For example, received data indicating a displacement of the operator input device 50 used to manipulate boom member 32 may be placed into a particular group while received data indicating pressure differences between the hydraulic chambers of hydraulic cylinder 42 may be placed in another group. Data relating to each parameter may include a signature unique to that particular parameter. After sorting the received data, a parameter to be analyzed may be selected (step 404). For example, the displacement of the operator input device 50 used to manipulate boom member 32 may be selected.

Once a parameter is selected, the parameter signature relating to the selected parameter may be compared to all reference signatures relating to the selected parameter (step 406). For example, when the displacement of the operator input device 50 used to manipulate boom member 32 is selected for analysis, the parameter signature relating to the displacement may be compared to the reference signatures associated with each operating mode of graphical representation 300. The comparison may use any method capable of determining which reference signature of the selected graphical representation most closely matches the parameter signature. In one exemplary embodiment, the comparison may be made by performing a root mean square (RMS) error analysis. It is contemplated that the reference signature may be taken from the graphical representations created in the method illustrated in FIG. 4 or any other source onboard or remote to machine 10.

Figure 8:
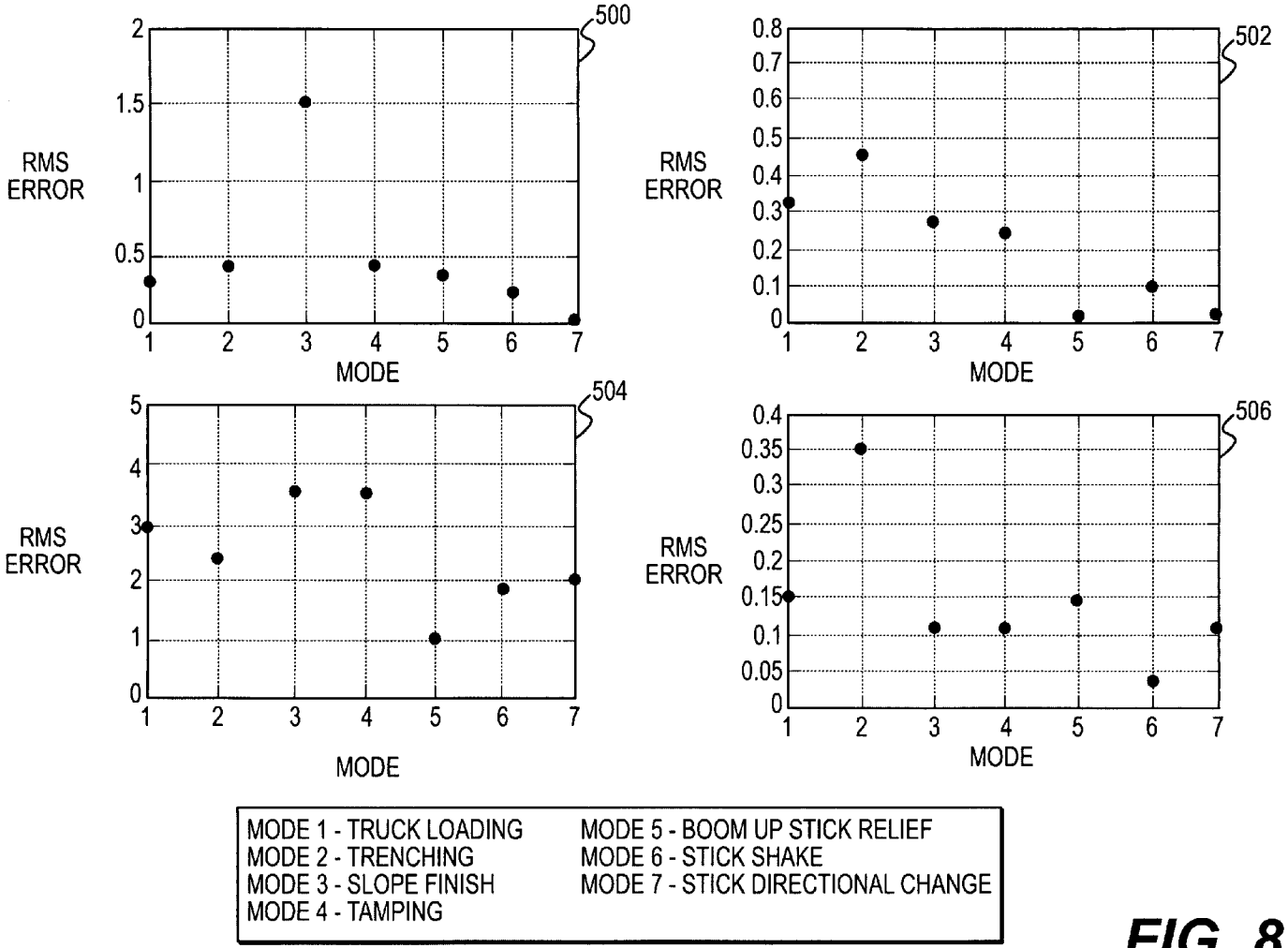
FIG. 8 illustrates exemplary graphical representations of data comparisons performed in the method of FIG. 7.
Figure 9:
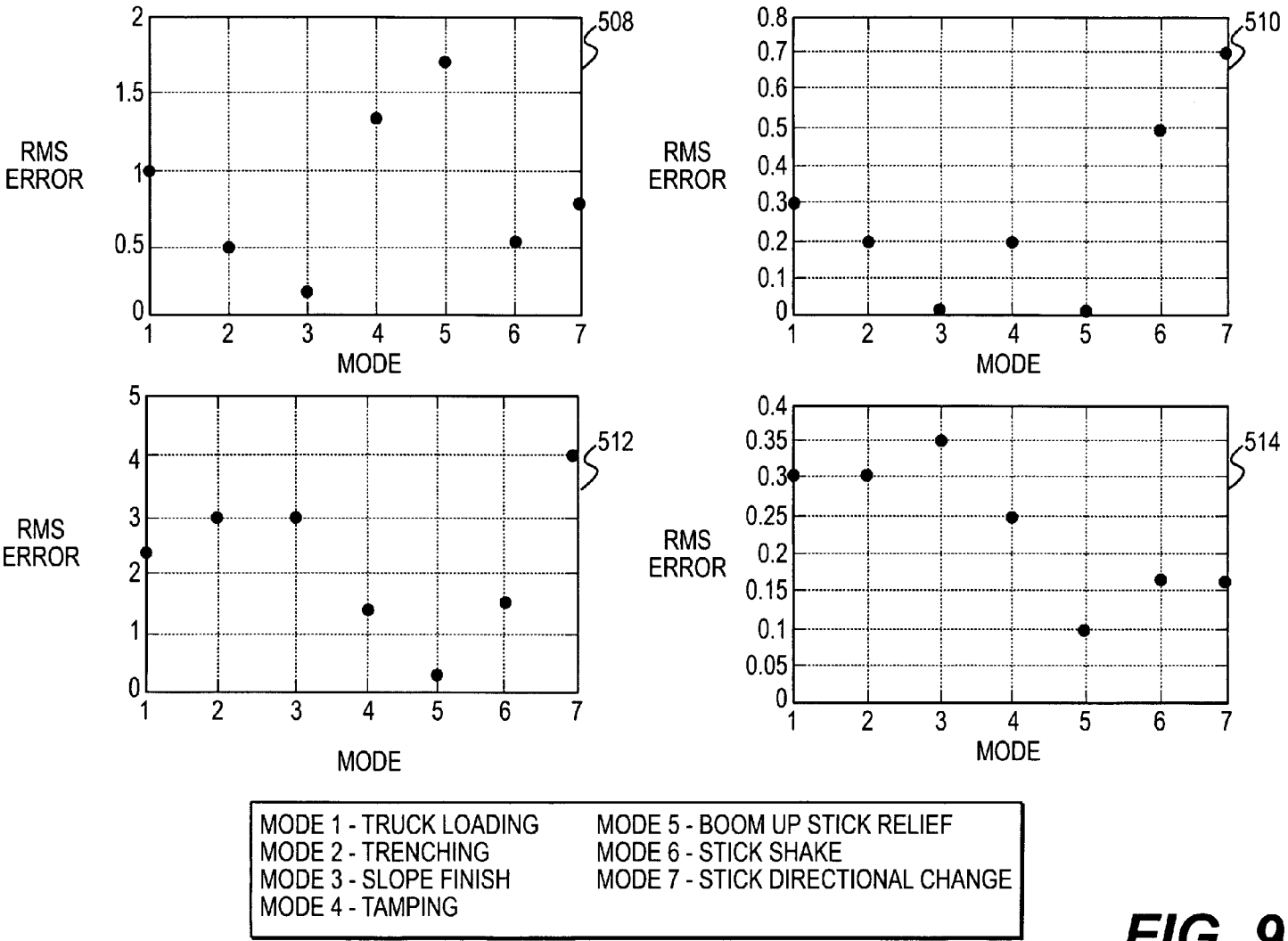
FIG. 9 illustrates additional exemplary graphical representations of data comparisons performed in the method of FIG. 7.

FIGS. 8 and 9 illustrate comparisons for various parameters utilizing an RMS error analysis. Each comparison may be represented by a chart including an x-axis representing the different operating modes and a y-axis representing the RMS error between the parameter signature and the reference signature. Data points located in each chart may represent how closely each reference signature correlates to the parameter signature. For example, the lower the RMS error value, the closer the correlation may be.

As illustrated in FIG. 8, a chart 500 may represent a comparison between parameter and reference signatures relating to the displacement of the operator input device 50 used to manipulate boom member 32. In chart 500, the closest correlation (i.e., lowest RMS error) between the parameter signature and the truck loading reference signature (mode 1) of graphical representation 300 may have an RMS error value of 0.25. This comparison may be repeated for each reference signature of graphical representation 300 until data points for each mode has been determined. As can be seen, the reference signature having the closest correlation with the parameter signature may be the stick directional mode reference signature (mode 7), which may have an RMS error value of zero. Therefore, the data relating to the current displacement of the operator input device 50 used to manipulate boom member 32 may indicate that machine 10 may be operating in the stick directional mode.

In addition to chart 500, FIG. 8 illustrates a chart 502 representing a comparison between parameter and reference signatures relating to the displacement of the operator input device used to manipulate tool 30, a chart 504 representing a comparison between parameter and reference signatures relating to the displacement of the operator input device used to manipulate stick member 38, and a chart 506 representing a comparison between parameter and reference signatures relating to the displacement of the operator input device used to manipulate swing motor 26. Furthermore, FIG. 9 illustrates a chart 508 representing a comparison between parameter and reference signatures relating the pressure differential between the hydraulic chambers of hydraulic cylinder 36, a chart 510 representing a comparison between parameter and reference signatures relating the pressure differential between the hydraulic chambers of hydraulic cylinder 44, a chart 512 representing a comparison between parameter and reference signatures relating the pressure differential between the hydraulic chambers of hydraulic cylinder 42, and a chart 514 representing a comparison between parameter and reference signatures relating the pressure differential between the hydraulic chambers of swing motor 26.

Some comparisons performed in step 406 may indicate more than one operating mode. For example, as can be seen in chart 502 more than one reference signature may be most closely correlated to the parameter signature (modes 5 and 7 may each have an RMS error value of zero). Therefore, the comparison represented by chart 502 may indicate more than one operating mode. A comparison indicating more than one operating mode may not be useful for determining the current operating mode of machine 10. Thus, it may be desired to determine whether the comparison performed in step 406 indicates more than one operating mode. As such, referring back to FIG. 7, processing device 60 may determine whether or not the comparison performed in step 406 indicates only one operating mode (step 408).

If processing device 60 determines that the comparison performed in step 406 indicates more than one operating mode (step 408: No), the comparison may be marked as unusable (step 410). A comparison marked as unusable may be omitted from any further data analyses performed in the method. In the exemplary embodiment illustrated in FIG. 8, chart 502 may indicate more than one mode of operation, and the comparison represented by chart 502 may be marked as unusable. Therefore, the results of the comparison represented by chart 502 may be omitted from future analyses. After marking the comparison as unusable or if processing device 60 determines that the comparison indicates only one operating mode (step 408: Yes), processing device 60 may determine whether data for all parameters has been analyzed (step 412). If data for any parameter has not been analyzed (step 412: No), step 404 may be repeated (i.e., a parameter to be analyzed may be selected).

If data for all of the parameters has been analyzed (step 412: Yes), processing device 60 may perform a primary analysis of the remaining comparisons that have not been marked as unusable and omitted (step 414). In the primary analysis, processing device 60 may count the number of comparisons indicating each operating mode. The operating mode indicated by the most comparisons may be the current operating mode of machine 10. For example, when analyzing the comparisons illustrated in FIGS. 8 and 9, comparison 500 may indicate the stick directional change mode, comparisons 504, 512, 514 may indicate the boom up stick relief mode, comparison 506 may indicate the stick shake mode, comparison 508 may indicate the slope finish mode, and comparisons 502, 510 may be omitted from the primary analysis because they may indicate more than one mode. Therefore, because the boom up stick relief mode may be indicated by the most comparisons (three comparisons), processing device 60 may determine that machine 10 may be currently operating in the boom up stick relief mode.

It is contemplated that instead of determining the current operating mode based on which mode may be identified by a plurality of the comparisons, the determination may be based on which mode may be identified by a majority of the comparisons. For example, if eight comparisons are performed to determine the current operating mode, the operating mode indicated by five or more comparisons may be the current operating mode. It is further contemplated that the number of comparisons needed for a majority may be reduced if any of the comparisons are marked as unusable. For example, if two of the eight comparisons are marked as unusable the number of comparisons needed to make majority may be reduced to four or more. If the comparisons illustrated in FIGS. 8 and 9 are analyzed using the majority analysis, they may not indicate a current operating mode because none of the operating modes may be indicated by four or more comparisons (the necessary majority may be reduced because two comparisons may be marked as unusable and omitted from the analysis).

After performing the primary analysis, processing device 60 may determine whether the primary analysis indicates an operating mode (step 416). If the primary analysis indicates an operating mode (step 416: Yes), that mode may be the current operating mode of machine 10, and the method may be terminated. However, if the primary analysis fails to indicate an operating mode (step 416: No), processing device 60 may determine which operating modes have been eliminated by the primary analysis (step 418). An operating mode may be eliminated if none of the comparisons indicate that mode. For example, none of the comparisons illustrated in FIGS. 8 and 9 indicate the truck loading mode, the trenching mode, or the tamping mode (modes 1, 2, and 4). Therefore, these modes may be eliminated from further consideration by the primary analysis.

After determining which operating modes have been eliminated by the primary analysis, processing device 60 may perform a supplemental analysis using supplemental data (step 420). supplemental data may be associated with machine parameters not previously utilized in the current operating mode determination method. The parameters associated with the supplemental data may include, for example, an engine load, manipulations of other operator input devices 50, hydraulic circuit pressures for operating modes utilizing circuit pressure relief commands, a position of tool 30, and/or any other parameter not previously used. The supplemental data may not necessarily be unique for each operating mode. Therefore, if performed in place of the primary analysis, the supplemental analysis may not be able to identify the current operating mode of machine 10. However, if the number of possible operating modes is narrowed down, the supplemental analysis may be useful for selecting one mode over another. It is contemplated that reference data for each operating mode relating to the supplemental data may be created from data recorded during previous operations of machine 10, created by performing a calibration event, created from a source located remotely from machine 10, or created by any other method capable of generating useful reference data.

When performing the supplemental analysis, the eliminated operating modes may be omitted from the analysis and the supplemental data may be compared to the remaining operating modes. For example, processing device 60 may compare a current engine load to data stored within processing device 60 that may identify engine loads typically experienced in each operating mode. Such a comparison may reveal that, of the operating modes being analyzed, the current engine load may be experienced only when machine 10 is operating in the slope finishing mode (mode 3). Therefore, the supplemental analysis may indicate that the current operating mode of machine 10 may be the slope finishing mode. It should be understood that even if the current engine load may be typically experienced in the truck loading mode, the trenching mode, and/or the tamping mode (modes 1, 2, and 4), processing device 60 may still determine that the current engine load may be experienced only when machine 10 is operating in the slope finishing mode. This is because, modes 1, 2, and 4 were eliminated by the primary analysis and may be omitted from the supplementary analysis.

After performing the supplemental analysis, processing device 60 may determine whether or not the supplemental analysis indicates only one operating mode (step 422). If the supplemental analysis indicates more than one operating mode (step 422: No), the method of FIG. 7 may fail to identify a current operating mode of machine 10 and step 400 may be repeated (i.e., processing device 60 may receive data indicative of various parameters of machine 10). However, if the supplemental analysis indicates only one operating mode (step 422: Yes), the indicated operating mode may be the current operating mode of machine 10, and the method may be terminated.

Dividing the data based on machine parameters and determining which operating modes may be identified by each machine parameter may permit the system to address inherent inconsistencies in the current data and increase the accuracy of the current operating mode determination. In particular, the system may remove or ignore parameter data that may indicate an incorrect operating mode. In addition, a supplemental analysis of machine parameters may permit the system to determine the current operating mode even when the originally selected machine parameters are unable to determine the current operating mode.

It will be apparent to those skilled in the art that various modifications and variations can be made in the disclosed system without departing from the scope of the disclosure. Other embodiments will be apparent to those skilled in the art from consideration of the specification disclosed herein. It is intended that the specification and examples be considered as exemplary only, with a true scope being indicated by the following claims and their equivalents.

What is claimed is:

1. A method for determining a current operating mode of a machine, comprising:

receiving data relating to a plurality of machine parameters;

performing initial comparisons between the received data and previously stored reference data for each machine parameter;

determining an operating mode indicated by each initial comparison; and selecting a current operating mode from the operating modes indicated by the initial comparisons, wherein any initial comparison that indicates more than one operating mode is disregarded during the selection.

2. The method of claim 1, wherein selecting the current operating mode further includes selecting the current operating mode only when one operating mode has been indicated by more initial comparisons than any other operating mode.

3. The method of claim 1, further including receiving supplemental data relating to one or more machine parameters and using the supplemental data in the selection of the current operating mode.

4. The method of claim 3, wherein the supplemental data is related to at least one of an engine load, manipulation of an input device, a pressure within a hydraulic circuit, or a position of a tool.

5. The method of claim 1, wherein selecting the current operating mode further includes selecting the current operating mode only when one operating mode has been indicated by a majority of the initial comparisons.

6. The method of claim 5, further including determining the number of initial comparisons needed for a majority based on the number of initial comparisons remaining after initial comparisons have been disregarded due to identifying more than one operating mode.

7. A method for determining a current operating mode of a machine, comprising:

creating and storing reference data for each of a plurality of machine parameters, the reference data for each machine parameter having unique reference signatures for each of a plurality of operating modes, wherein creating and storing the reference data includes operating the machine in all available operating modes, the machine being operated in each operating mode for a predetermined period of time;

receiving current data relating to the plurality of machine parameters, the current data relating to each machine parameter having a unique parameter signature;

performing initial comparisons between the parameter signature and the reference signatures for each machine parameter;

determining an operating mode indicated by each initial comparison; and selecting a current operating mode from the operating modes indicated by the initial comparisons, wherein any initial comparison that indicates more than one operating mode is omitted from being selected as the current operating mode.

8. The method of claim 7, wherein the predetermined period of time in which the machine operates in a particular operating mode varies from operating mode to operating mode.

9. The method of claim 8, wherein creating and storing the reference data further includes refraining from storing data for a period of time when transitioning between operating modes.

10. The method of claim 9, wherein selecting the current operating mode further includes selecting the current operating mode only when one operating mode has been indicated by more initial comparisons than any other operating mode.

11. The method of claim 9, further including receiving supplemental data relating to one or more machine parameters and using the supplemental data in the selection of the current operating mode.

12. The method of claim 11, wherein selecting the current operating mode further includes selecting the current operating mode only when one operating mode has been indicated by a majority of the initial comparisons.

13. The method of claim 12, further including determining the number of initial comparisons needed for a majority based on the number of initial comparisons remaining after initial comparisons have been disregarded due to identifying more than one operating mode.

14. The method of claim 11, wherein the supplemental data is related to at least one of an engine load, manipulation of an input device, a pressure within a hydraulic circuit, or a position of a tool.

15. An operating mode determination system for a machine, including:

one or more operator input devices;

one or more sensors; and a processing device configured to:

receive data from the one or more operator input devices and the one or more sensors, the data being related to a plurality of machine parameters;

perform initial comparisons between the received data and the reference data for each machine parameter;

determine an operating mode indicated by each initial comparison; and select a current operating mode from the operating modes indicated by the initial comparisons, wherein any initial comparison that indicates more than one operating mode is disregarded during the selection.

16. The operating mode determination system of claim 15, wherein the processing device is configured to select the current operating mode only when one operating mode has been indicated by more initial comparisons than any other operating mode.

17. The operating mode determination system of claim 16, wherein the processing device is configured to receive supplemental data from the one or more sensors or one or more operator input devices, and the supplemental data is used in the selection of the current operating mode.

* * * * *